US012084812B2

(12) United States Patent
Chen et al.

(10) Patent No.: US 12,084,812 B2
(45) Date of Patent: Sep. 10, 2024

(54) PULP MOLDING PRODUCTION LINE AND PROCESSING METHOD

(71) Applicant: Zhejiang Shurcon Manufacturing Co. Ltd., Zhejiang (CN)

(72) Inventors: Shu Chen, Long Grove, IL (US); Gang Cen, Zhejiang (CN)

( * ) Notice: Subject to any disclaimer, the term of this patent is extended or adjusted under 35 U.S.C. 154(b) by 140 days.

(21) Appl. No.: 17/427,527

(22) PCT Filed: Dec. 24, 2019

(86) PCT No.: PCT/CN2019/128104

§ 371 (c)(1),
(2) Date: Jul. 30, 2021

(87) PCT Pub. No.: WO2020/155948

PCT Pub. Date: Aug. 6, 2020

(65) Prior Publication Data

US 2022/0025579 A1 Jan. 27, 2022

(30) Foreign Application Priority Data

Jan. 31, 2019 (CN) ..... 201910098112.8

(51) Int. Cl.
*D21F 13/12* (2006.01)
*D21F 2/00* (2006.01)
(Continued)

(52) U.S. Cl.
CPC ..... *D21F 13/12* (2013.01); *D21F 2/00* (2013.01); *D21F 3/0272* (2013.01); *D21F 7/02* (2013.01); *D21J 3/00* (2013.01)

(58) Field of Classification Search
CPC ..... D21F 13/12; D21F 2/00; D21F 3/0272; D21F 7/02; D21J 7/00; D21J 3/00; D21J 3/10; B65D 81/02; B65D 43/0212
See application file for complete search history.

(56) References Cited

U.S. PATENT DOCUMENTS 1,163,005 A 12/1915 Hall
2,879,935 A 3/1959 Carter
(Continued)

FOREIGN PATENT DOCUMENTS

CN 87206542 U 9/1988
CN 2035341 U 4/1989
(Continued)

OTHER PUBLICATIONS

International Search Report in International Application No. PCT/CN2019/128104, mailed Mar. 18, 2020 (6 pages).
(Continued)

*Primary Examiner* — Jacob T Minskey
*Assistant Examiner* — Matthew M Eslami
(74) *Attorney, Agent, or Firm* — Benesch Friedlander Coplan & Aronoff LLP

(57) ABSTRACT

A pulp molding production line includes a forming machine, a pulp molding manipulator and a press. The pulp molding manipulator having a mounted transfer device which includes a wet blank transfer mold having an interior airtight air chamber. A front face of the wet blank transfer mold is provided with at least one recessed matching cavity that can be sleeved on an outside of a wet pulp blank product that is recessed toward the airtight air chamber, and the recessed matching cavity matches the product. An inner wall and a bottom of the recessed matching cavity are respectively provided with a plurality of small communicating holes. A back face of the wet blank transfer mold is connected to a moving frame through a guide mechanism. A driver connects between the back of the wet blank transfer mold and a moving frame which is provided with uniformly spaced vacuum cups.

13 Claims, 11 Drawing Sheets

(51) Int. Cl.

| | |
|---|---|
| ***D21F 3/02*** | (2006.01) |
| ***D21F 7/02*** | (2006.01) |
| ***D21J 3/00*** | (2006.01) |

(56) References Cited

U.S. PATENT DOCUMENTS

| | | | | |
|---|---|---|---|---|
| 3,065,875 | A | 11/1962 | Negoro | |
| 5,628,402 | A | 5/1997 | Dickie et al. | |
| 5,678,692 | A | 10/1997 | Gratz | |
| 6,082,543 | A | 7/2000 | Beliveau | |
| RE37,253 | E | 7/2001 | Moren et al. | |
| 6,405,866 | B2 | 6/2002 | Arima | |
| 6,576,089 | B1 | 6/2003 | Sato et al. | |
| 6,918,997 | B2 | 7/2005 | Goto et al. | |
| 8,511,473 | B1 | 8/2013 | Bontrager et al. | |
| 8,701,891 | B2 | 4/2014 | Bontrager et al. | |
| 9,138,898 | B2 | 9/2015 | Liu | |
| 2003/0051845 | A1 | 3/2003 | Gale et al. | |
| 2003/0111201 | A1 | 6/2003 | Sato et al. | |
| 2004/0055928 | A1 | 3/2004 | Smith | |
| 2004/0084166 | A1 | 5/2004 | Nanomura et al. | |
| 2006/0131788 | A1 | 6/2006 | Takigawa | |
| 2010/0294448 | A1 | 11/2010 | Pierce et al. | |
| 2011/0113622 | A1 | 5/2011 | Liu | |
| 2013/0134069 | A1 | 5/2013 | Babey et al. | |
| 2015/0292154 | A1* | 10/2015 | Zheng | D21F 9/04 162/226 |
| 2018/0086511 | A1 | 3/2018 | Lin | |
| 2019/0010663 | A1 | 1/2019 | Chen et al. | |

FOREIGN PATENT DOCUMENTS

| | | | | |
|---|---|---|---|---|
| CN | 2055127 | U | | 3/1990 |
| CN | 2138642 | Y | | 7/1993 |
| CN | 2439458 | Y | | 7/2001 |
| CN | 1423719 | A | | 6/2003 |
| CN | 2832697 | Y | | 11/2006 |
| CN | 101288890 | A | | 9/2008 |
| CN | 102465477 | A | | 5/2012 |
| CN | 102733268 | A | | 10/2012 |
| CN | 202595578 | U | | 12/2012 |
| CN | 101961921 | B | | 3/2013 |
| CN | 203030868 | U | | 7/2013 |
| CN | 102059706 | B | | 8/2013 |
| CN | 203622422 | U | | 6/2014 |
| CN | 203668762 | U | | 6/2014 |
| CN | 204263176 | U | | 4/2015 |
| CN | 204264636 | U | | 4/2015 |
| CN | 105253621 | A | | 1/2016 |
| CN | 205387641 | U | | 7/2016 |
| CN | 106436489 | A | | 2/2017 |
| CN | 206142441 | U | | 5/2017 |
| CN | 107059491 | A | | 8/2017 |
| CN | 107195954 | A | | 9/2017 |
| CN | 206590564 | U | | 10/2017 |
| CN | 107813545 | A | | 3/2018 |
| CN | 107815930 | | | 3/2018 |
| CN | 107915044 | A | | 4/2018 |
| CN | 207259870 | U | | 4/2018 |
| CN | 207404482 | U | | 5/2018 |
| CN | 108130824 | A | | 6/2018 |
| CN | 108396595 | A | | 8/2018 |
| CN | 108457132 | A | | 8/2018 |
| CN | 108589432 | A | | 9/2018 |
| CN | 208072083 | U | * | 11/2018 |
| CN | 208121482 | U | | 11/2018 |
| CN | PR-208072083 | U | * | 11/2018 |
| CN | 208658569 | U | | 3/2019 |
| CN | 110216710 | A | | 9/2019 |
| CN | 110219210 | A | | 9/2019 |
| CN | 209599250 | U | | 11/2019 |
| CN | 209619753 | U | | 11/2019 |
| EP | 0798225 | A1 | | 10/1997 |
| EP | 1074657 | A1 | | 2/2001 |
| EP | 1285994 | A1 | | 2/2003 |
| JP | 2001254300 | A | | 9/2001 |
| JP | 2001303498 | A | | 10/2001 |
| JP | 2007039093 | A | | 2/2007 |
| TW | M538917 | U | | 4/2017 |
| TW | I610007 | B | | 1/2018 |
| WO | 03014471 | A1 | | 2/2003 |
| WO | 2010124300 | A1 | | 10/2010 |
| WO | 2018/216544 | A1 | | 11/2018 |
| WO | 2019141117 | A1 | | 7/2019 |

OTHER PUBLICATIONS

Written Opinion in International Application No. PCT/CN2019/128104, mailed Mar. 18, 2020 (4 pages).

Extended European Search Report dated Sep. 27, 2022 for European Application No. 19913805.8, 7 pages.

China National Intellectual Property Administration (ISA/CN), Search Report and Written Opinion of the International Searching Authority (with English translation), International Application No. PCT/CN2019/128104, 9 pages, Mar. 18, 2020.

China National Intellectual Property Administration (ISA/CN), International Search Report (with English translation), International Application No. PCT/CN2019/128103, 8 pages, Mar. 19, 2020.

China National Intellectual Property Administration (ISA/CN), Written Opinion of the International Searching Authority (with English translation), International Application No. PCT/CN2019/128103, 8 pages, Mar. 19, 2020.

U.S. Patent and Trademark Office, Non-Final Office Action, U.S. Appl. No. 16/709,317, 13 pages, Aug. 11, 2021.

U.S. Patent and Trademark Office, Final Office Action, U.S. Appl. No. 16/709,317, 10 pages, May 6, 2022.

U.S. Patent and Trademark Office, Advisory Action, U.S. Appl. No. 16/709,317, 3 pages, Jul. 18, 2022.

US, Restriction Requirement, U.S. Appl. No. 15/844,556, 6 pages, Jul. 1, 2019.

US, Non-Final Office Action; U.S. Appl. No. 15/844,556, 9 pages, Sep. 19, 2019.

US, Final Office Action; U.S. Appl. No. 15/844,556, 6 pages, Feb. 12, 2020.

US, Notice of Allowance, U.S. Appl. No. 13/559,132, 7 pages, Jun. 27, 2013.

US, Notice of Allowance, U.S. Appl. No. 13/970,232, 8 pages, Dec. 4, 2013.

PCT, International Search Report with English translation, and Written Opinion, PCT Patent Application No. PCT/CN2019/070942, 11 pages, Apr. 8, 2019.

First Opinion in CN Application No. CN201910098112.8, dated Apr. 28, 2023 (10 pgs.).

First Opinion in CN Application No. CN201910098115.1, dated Dec. 21, 2023 (6 pgs.).

* cited by examiner

PULP MOLDING PRODUCTION LINE AND PROCESSING METHOD

CROSS REFERENCED TO RELATED APPLICATION

This application claims priority to and the benefit from International Application PCT/CN2019/128104 titled "Pulp Molding Production Line And Processing Method", filed on Dec. 24, 2019, which claims priority and the benefit from Chinese Application CN 201910098112.8, filed on Jan. 31, 2019, the contents of which are herein incorporated by reference in their entirety.

TECHNICAL FIELD

The present application relates generally to the technical field of pulp molding machinery, and particularly relates to a pulp molding production line and a pulp molding processing method.

BACKGROUND

During the production and processing of pulp molded products, it is necessary to carry out cold extrusion and hot forming, and the material is transported by manipulator between cold extrusion and hot forming.

The existing pulp molding production manipulator is generally equipped with a transfer mold jig, which is used to transfer the pulp molding wet blank to the mold or obtain and release the pressed products. Since only one action can be performed at any given time, and the wet blank transfer and product acquisition and release cannot be completed at the same time, resulting in low production efficiency.

For example, Chinese patent application number CN 201320735610.7 discloses a handling manipulator for pulp molding machine. The manipulator has three degrees of freedom and can move in X, Y and Z directions. The movement (lateral movement) in the X direction is realized by two rod-less cylinders and linear guide rails, which can accurately realize the positioning in three states. The Y-direction movement (translation) and Z-direction movement (vertical lifting) can be realized by motor and screw rods, which can realize accurate positioning at any position within the travel range. The grasping and lowering of steel pallets are realized by turning on and off electromagnets. The manipulator can directly catch the goods produced by the pulp molding machine from the mold with pallets, and then place them on the trolley in sequence. The manipulator is simple in structure, easy to manufacture, low cost and stable in performance, which can replace manpower and save labor and production cost.

Although the above scheme has many advantages, it does not solve the above technical problems.

SUMMARY

The purpose of the present disclosure is to provide a paper pulp molding production line and a processing method which can greatly improve production efficiency for the above problems.

In order to achieve the above purpose, the present disclosure adopts the following technical scheme:

A pulp molding production line includes at least one molding machine, a pulp molding manipulator and at least one press, wherein the molding machine, the pulp molding manipulator and the press are arranged in sequence, and a transfer device is installed on the pulp molding manipulator, which takes and transfers wet pulp blank products molded by the molding machine to the press, and takes, transfers and releases the pulp products molded by the press, a wet blank transfer mold is internally provided with an airtight air chamber inside, a front face of the wet blank transfer mold is provided with at least one recessed matching cavity which can be sheathed on the outside of a pulp wet blank container and is recessed towards the airtight air chamber, and the recessed matching cavity matches the pulp wet blank container; several small communicating holes for communication between the recessed matching cavity and the airtight air chamber are respectively provided in an inner wall of each recessed matching cavity and at the bottom of the recessed matching cavity, the small communicating holes provided in the inner wall of the recessed matching cavity are circumferentially uniformly distributed to form at least one circle in an encircling manner, and the small communicating holes provided at the bottom of the recessed matching cavity are circumferentially uniformly distributed to form at least one circle in an encircling manner; a moving frame parallel to the wet blank transfer mold is connected to a back face of the wet blank transfer mold via a guiding mechanism; a driver is connected between the back face of the wet blank transfer mold and the moving frame and drives the moving frame to move relative to the wet blank transfer mold; several evenly spaced vacuum cups are provided on the moving frame, and the vacuum cups and the airtight air chamber are respectively connected to a vacuum-pumping system.

Preferably, two circles are provided at the bottom of the recessed matching cavity, and each circle is respectively formed by several circumferentially evenly distributed small communicating holes.

Preferably, the center of the bottom of the recessed matching cavity is provided with central holes for communicating the recessed matching cavity with the airtight air chamber.

Preferably, the wet blank transfer mold includes a main mold plate with a cavity on the back, wherein the cavity has an opening communicated with the outside, and several recessed matching cavities distributed in an array are provided on the front face of the main mold plate; several small communicating holes for communication between the recessed matching cavity and the airtight air chamber are respectively provided in the inner wall of each recessed matching cavity and at the bottom of the recessed matching cavity, the inner bottom part of the cavity is provided with several inner convex parts corresponding to the recessed matching cavities one by one, and the small communicating holes penetrate through the inner convex parts; the wet blank transfer mold also includes a closing mold plate for closing the cavity opening, and the airtight air chamber is formed between the main mold plate and the closing mold plate.

Preferably, the bottom of the chamber is provided with a reinforcing supporting structure contacting with a surface of the closing mold plate near to the chamber.

Preferably, the reinforcing supporting structure includes several first reinforcing supporting bulges with uniform transverse spacing and several second reinforcing supporting bulges with uniform longitudinal spacing, wherein the first reinforcing supporting bulges are located on the same straight line and at the transverse center of the chamber, the second reinforcing supporting bulges are located on the same straight line and at the longitudinal center of the chamber, the first reinforcing supporting bulges and the second reinforcing supporting bulges are in a cross shape, and one end of the first reinforcing supporting bulges far away from the bottom of the chamber abut against a surface of the closing mold plate near to the chamber, and one end of the second reinforcing supporting bulges far away from the bottom of the chamber abut against a surface of the closing mold plate near to the chamber.

Preferably, a first supporting plane is provided at one end of each first reinforcing supporting bulge abutting against the closing mold plate, and a second supporting plane is provided at one end of each second reinforcing supporting bulge abutting against the closing mold plate, and the first supporting plane and the second supporting plane are located in the same horizontal plane.

Preferably, the inner wall of the chamber is provided with several arc-shaped concave surfaces which are connected in sequence, and the outermost inner convex part of the inner convex parts corresponds to the arc-shaped concave surface one by one.

Preferably, the guiding mechanism includes several guide posts which are parallel to each other and one end of which is fixed on the back of the wet blank transfer mold, several guide sleeve fixing holes and guide sleeves fixed on the guide sleeve fixing holes are provided on the moving frame, and the guide sleeves are set on the guide posts one by one, and the guide sleeves are in sliding connection with the guide posts.

Preferably, six recessed matching cavities are taken as one area, and four such areas are provided on the front face of the wet blank transfer mold.

Preferably, two adjacent first reinforcing supporting bulges are connected by first arc-shaped connecting ribs, two second reinforcing supporting bulges are located outside the middle-most first reinforcing supporting bulge, and each second reinforcing supporting bulge is connected with the middle-most first reinforcing supporting bulge by a second arc-shaped connecting rib.

Preferably, the main mold plate and the closing mold plate are connected by a detachable connection structure.

Preferably, the detachable connection structure includes an annular shoulder provided in the circumferential direction of the main mold plate, wherein the thickness of the annular shoulder is smaller than that of the main mold plate, the back surface of the main mold plate is flush with that of the annular shoulder, each side edge of the closing mold plate is respectively pierced with a locking bolt which penetrates through a nail passing hole of the annular shoulder and is sheathed with a locking nut, and the lock nut is in contact with the front face of the annular shoulder.

Preferably, the front face of the annular shoulder is provided with a yielding notch communicated with the nail passing hole, and the locking nut is positioned in the yielding notch and contacts with the bottom surface of the yielding notch.

The molding machine is of the prior art. The press includes a lower base, four vertical guide posts connected to the top of the lower base, an upper mold holder connected to the upper ends of the four vertical guide posts, and also a movable lower mold holder movably connected with the vertical guide posts; the movable lower mold holder is connected with the master cylinder of the press and drives the movable lower mold holder to lift axially along the vertical guide posts, which is characterized in that the press also includes an auxiliary frame located between the movable lower mold holder seat and the upper mold holder, and the auxiliary frame is connected with the lifting drive mechanism.

The auxiliary frame is sleeved on the transfer device, and the auxiliary frame assists the transfer device to lift and fall under the action of external force.

The auxiliary frame includes an auxiliary push plate, the edges of which are provided with four guide round holes for the vertical guide posts to penetrate one by one, and the auxiliary push plate is provided with a polygonal central through hole, and the guide round holes are located at the periphery of the polygonal central through hole.

Preferably, the polygonal central through hole is an octagonal through hole.

Preferably, the periphery of the auxiliary push plate is provided with outer sides corresponding to the walls of the octagonal through holes one by one, and the outer sides form an octagon.

Preferably, the reinforcing structure includes transverse reinforcing ribs connected between the two cantilever bosses and connected with the outer wall of the auxiliary push plate, longitudinal reinforcing ribs are arranged in the middle of the transverse reinforcing ribs and the inner end of the longitudinal reinforcing ribs are connected with the outer wall of the auxiliary push plate.

Preferably, the upper orifice and the lower orifice of the octagonal through hole are respectively provided with the first circular chamfers, and the two sides of each outer side are respectively provided with the second circular chamfers.

Preferably, the lifting driving mechanism includes two fixed frame respectively fixed on the top part of the lower base, a first cylinder is fixed in each fixed frame body, and the telescopic rods of the first cylinders face upwards and are connected to the middle part of the lower surface of the transverse reinforcing ribs one by one.

The first cylinder can be replaced by an oil cylinder or a linear motor.

Preferably, the fixing frame body is rectangular and vertically fixed, with a first elongated hole in its upper central area and a second elongated hole in its lower central area. The telescopic rod of the first cylinder penetrates through the first elongated hole and a fixing plate is sleeved on the upper end of the first cylinder. The fixing plate is located on the upper surface of the orifice of the first elongated hole, and several first bolts extend through the fixing plate, are connected through threads with the screw holes at the top of the fixing frame body, and the lower end of the first cylinder penetrates through the second elongated hole.

Compared with prior art, the present disclosure has the advantages in that:

1. Compared with prior art, the transfer of wet blanks and the taking of products can be carried out at the same time, the manipulator does not need to move, and the vacuum cup is extended to the product mold through the built-in direct-acting device to take out the products, thus achieving the purpose of transferring wet blanks and products at the same time, and greatly improving the production efficiency.
2. The transfer device has simple structure and low manufacturing cost.
3. The production line has greatly improved the production efficiency.
4. The lifting drive mechanism drives the auxiliary push plate to lift or fall between the movable lower mold holder and the upper mold holder. At this time, under the action of the auxiliary push plate, the transfer device connected to the manipulator can be forced to lift up or down, the manipulator does not need to perform upward or downward thrust action, thereby ensuring the reliability of the manipulator and prolonging the service life of the manipulator, and the production can be carried out continuously and smoothly, which is more in line with the production requirements of enterprises.

Figure 1:
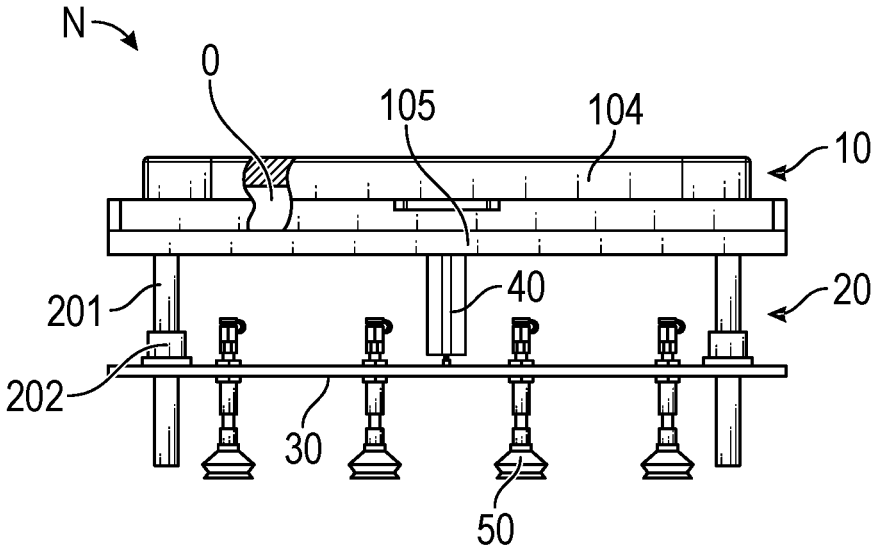
FIG. 1 is a schematic structural diagram of the transfer device of the present disclosure.

Reference designations in the figures are as follows: airtight air chamber 0, wet blank transfer mold 10, recessed matching cavity 101, small communicating holes 102, small central hole 103, main mold plate 104, cavity 1041, inner convex part 1042, first reinforcing supporting bulge 1043, second reinforcing supporting bulge 1044, first supporting plane 1045, second supporting plane 1046, arc concave surface 1047, first arc connecting rib 1048, second arc connecting rib 1049, closing mold plate 105, annular shoulder 106, yielding notch 107, guiding mechanism 20, guide post 201, guide sleeve 202, moving frame 30, driver 40, vacuum cup 50, vacuum-pumping system 60, pulp molding manipulator 3*a*, press 2*a*, transfer device Q, auxiliary frame N, auxiliary push plate 1, polygonal central through hole 11, first circular chamfer 111, second circular chamfer 112, cantilever lug boss 12, circular guide hole 121, reinforcing structure 13, transverse reinforcing rib 131, longitudinal reinforcing rib 132, lower base 2, vertical guide post 21, upper mold holder 3, movable lower mold holder 4, press master cylinder 41, lifting drive mechanism 5, fixed frame body 51, first elongated hole 511, second elongated hole 512, fixed plate 513, first bolt 514, and first cylinder 52.

DETAILED DESCRIPTION

The following is a detailed description of exemplary embodiments of the present disclosure with reference to the drawings, but the disclosure is not be limited to these embodiments.

Figure 8:
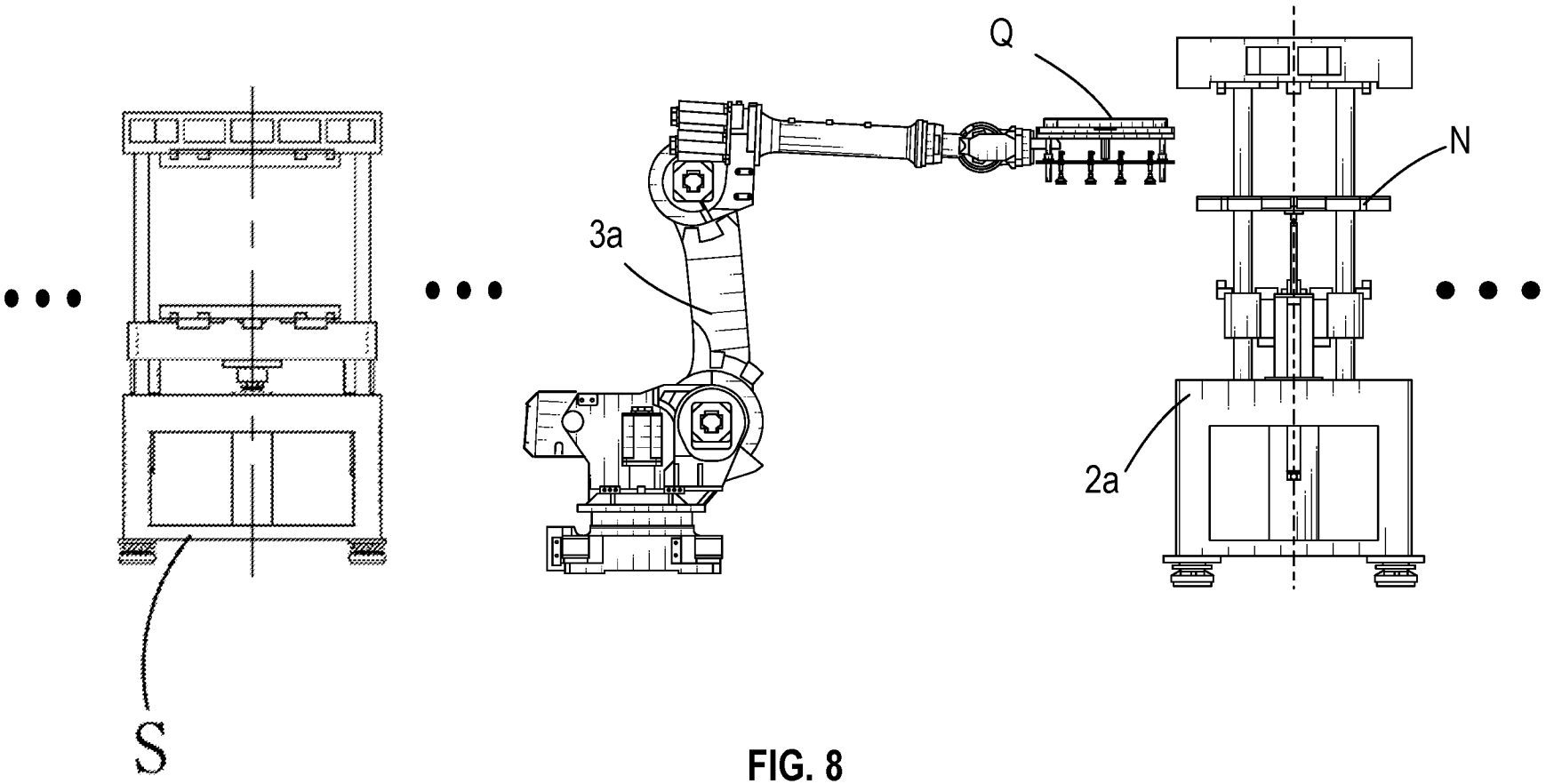
FIG. 8 is a schematic structural diagram of the production line of the present disclosure.
Figure 9:
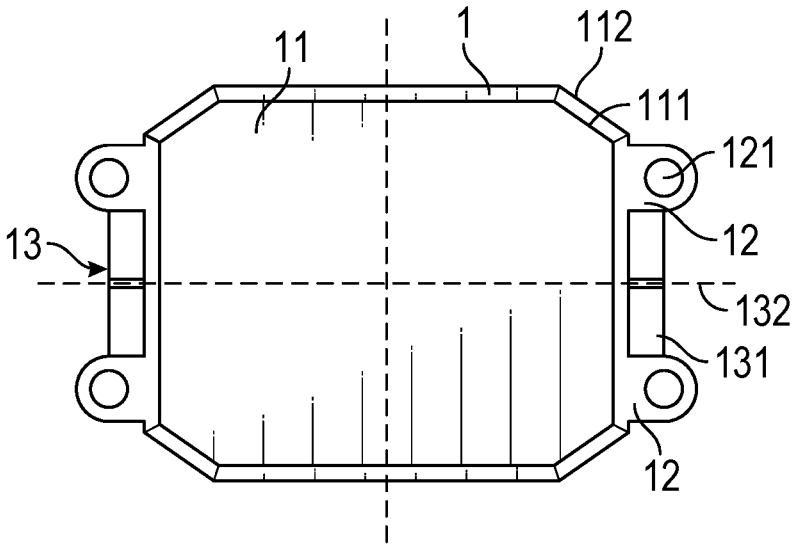
FIG. 9 is a schematic structural diagram of the auxiliary frame of the present disclosure.
Figure 10:
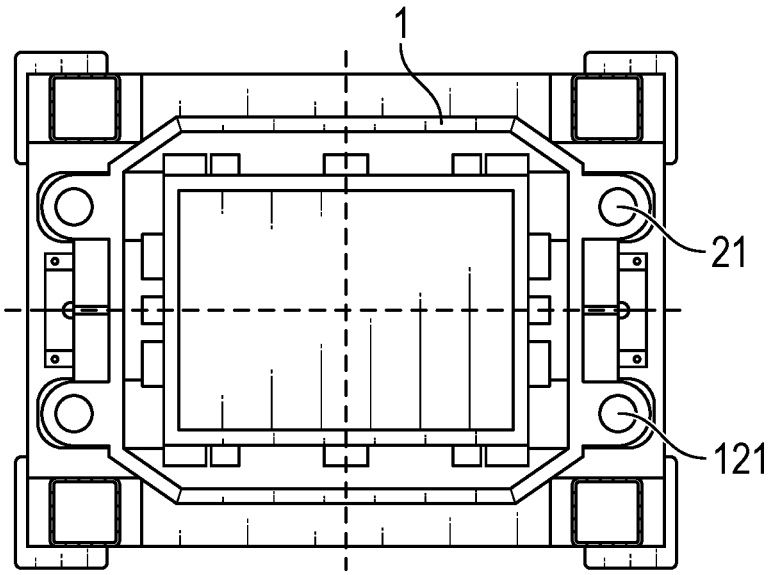
FIG. 10 is a structural diagram of the auxiliary frame of the present disclosure installed on the press.
Figure 11:
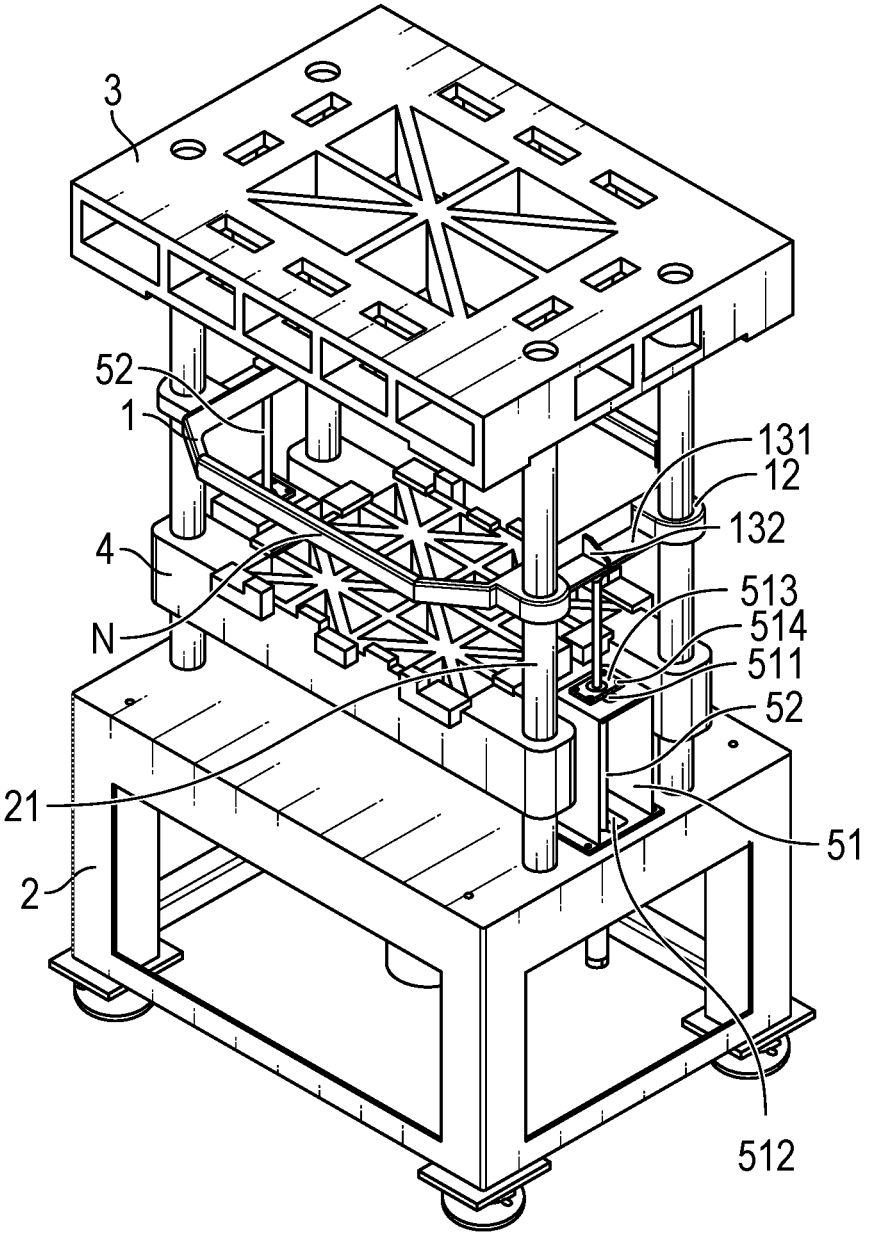
FIG. 11 is a schematic diagram of the three-dimensional structure of the press of the present disclosure.
Figure 12:
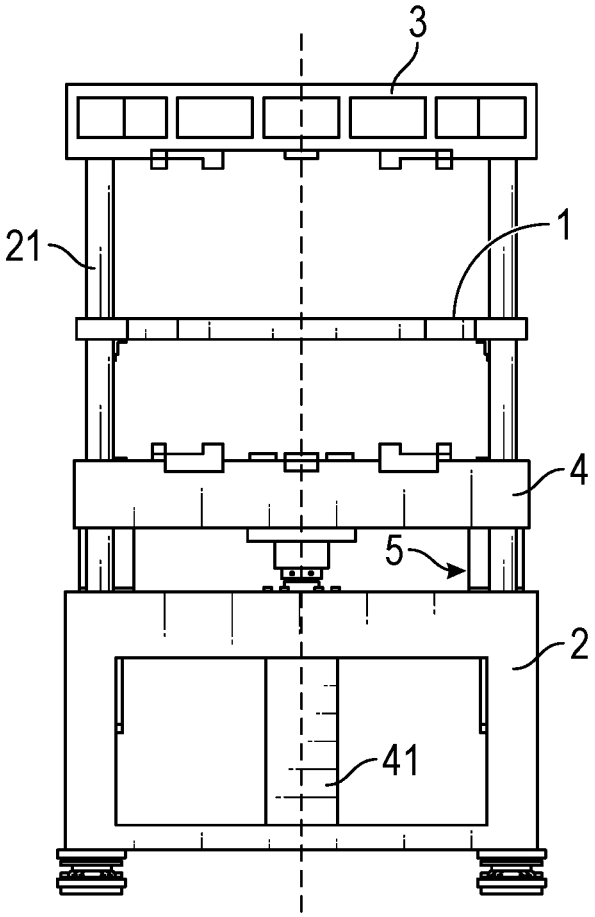
FIG. 12 is a schematic structural diagram of the press of the present disclosure.

As shown in FIG. 8, a pulp molding production line includes at least one molding machine S, a pulp molding manipulator 3*a* and at least one press 2*a*, wherein the molding machine, the pulp molding manipulator 3*a* and the press 2*a* are arranged in sequence, and a transfer device Q is installed on the pulp molding manipulator, and the transfer device acquires and transfers wet pulp products molded by the molding machine to the press, and acquires, transfers and releases pulp products molded by the press.

Figure 13:
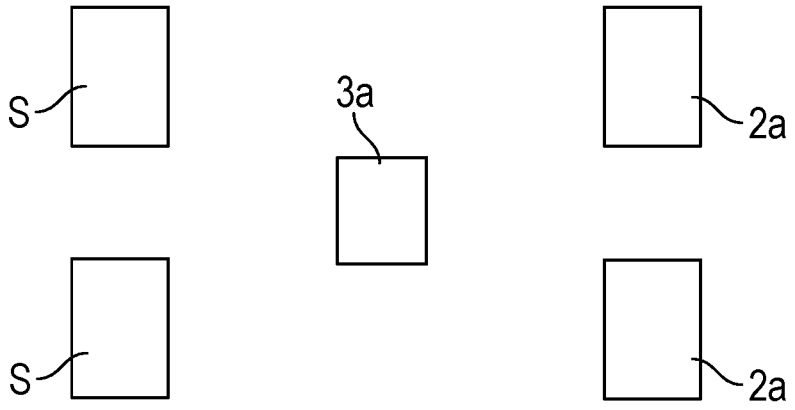
FIG. 13 is a block diagram of the simplified distribution state of the production line provided by the present invention.
Figure 14:
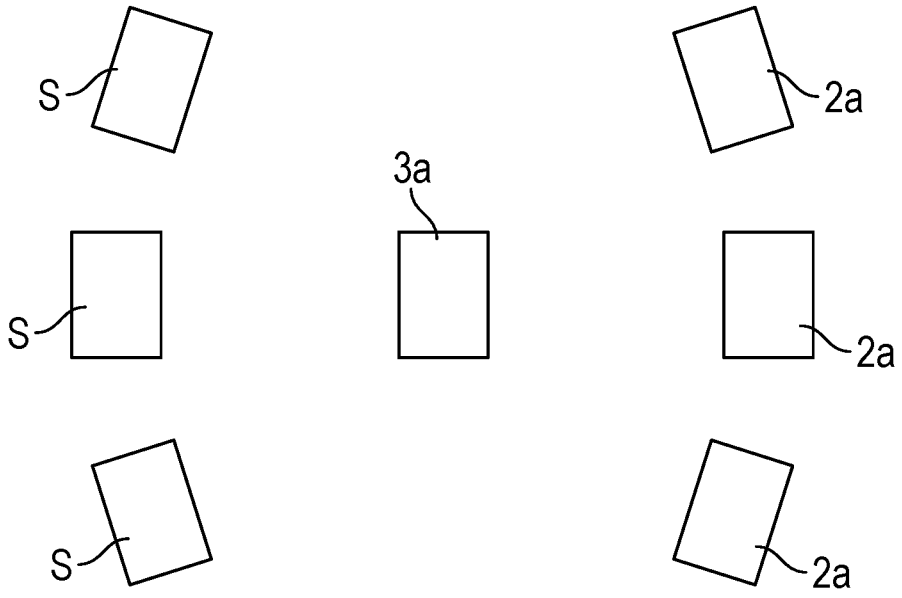
FIG. 14 is a second block diagram of simplified distribution state of production line provided by the present invention.

As shown in FIGS. 13-14, there are several forming machines S; in the case of two machines, they are arranged at intervals, in the case of three, they are arranged in a row or triangle or arch shape, and in the case of four, they are arranged in a row or arch shape.

Similarly, the arrangement pattern of the press 2*a* is consistent with that of the molding machine S. Of course, there are still many arrangement modes, they will not be listed one by one herein.

As shown in FIGS. 1-7, a transfer device includes a wet blank transfer mold 10 internally provided with an airtight air chamber 0, and at least one recessed matching cavity 101 which can be sheathed outside a pulp wet blank container and recessed toward the airtight air chamber 0 is provided on the front face of the wet blank transfer mold 10, and the recessed matching cavity 101 matches the pulp wet blank container. This structure can enlarge the contact surface with the wet blank container, and improve the efficiency and stability of material taking.

On an inner wall of each recessed matching cavity 101 and a bottom of each recessed matching cavity 101, several small communicating holes 102 are respectively used for communicating the recessed matching cavities with the airtight air chamber 0, the small communicating holes 102 provided on the inner wall of the recessed matching cavity 101 are circumferentially uniformly distributed to form at least one circle in an encircling manner. The small communicating holes 102 provided at the bottom of the recessed matching cavity 101 are circumferentially uniformly distributed to form at least one circle in an encircling manner. By designing at least one circle of small communicating holes 102 at different positions, the stability of material taking can be ensured.

In the preferred scheme, there are two circles at the bottom of the recessed matching cavity 101 in this embodiment, and each circle is formed by several small communicating holes 102 evenly distributed around the circumference.

Secondly, the center of the bottom of the recessed matching cavity 101 is provided with a small central hole 103 for communicating the recessed matching cavity 101 with the airtight air chamber 0.

A moving frame 30 parallel to the wet blank transfer mold 10 is connected to the back face of the wet blank transfer mold 10 via a guiding mechanism 20, wherein the guiding mechanism 20 includes several guide posts 201 which are parallel to each other and one end of which is fixed on the back face of the wet blank transfer mold 10, the moving frame 30 is provided with several guide sleeve fixing holes and guide sleeves 202 fixed on the guide sleeve fixing holes, the guide sleeves 202 are set on the guide posts 201, and the guide sleeves 202 are in sliding connection with the guide posts 201.

The coordination of guide sleeves 202 and guide posts 201 can further improve the smoothness and stability of lifting and lowering.

A driver 40 is connected between the back surface of the wet blank transfer mold 10 and the moving frame 30, and drives the moving frame 30 to move relative to the wet blank transfer mold 10. The driver 40 is any one of an air cylinder, an oil cylinder and a linear motor.

The moving frame 30 is provided with several evenly spaced vacuum cups 50, and the vacuum cups 50 and the airtight air chamber 0 are respectively connected with a vacuum-pumping system 60. The vacuum-pumping system 60 includes a vacuum pumping pipeline and vacuum pumping equipment connected with the vacuum pumping pipeline, and the vacuum pumping equipment is a commercially available product.

That is, when vacuum pumping equipment operates, the air in the airtight air chamber 0 is forced to be sucked out, and at this time, the wet blank container can be sucked and transferred into the forming mold by using the communicating hole 102 and the center hole 103, i.e., into the upper mold or the lower mold of the forming mold, and at the same time, the vacuum cup 50 can be lifted or lowered by the action of the driver, so as to suck the pulp molded products formed by the molding mold, and can complete the transfer and taking and placing actions at the same time, thus greatly improving the production and processing efficiency.

When releasing, just change vacuum pumping action to blowing action. Specifically, the wet blank transfer mold 10 of this embodiment includes a main mold plate 104 with a cavity 1041 on the back face, the cavity 1041 has an opening communicating with the outside, and several recessed matching cavities 101 distributed in an array are provided on the front face of the main mold plate 104. Several small communicating holes 102 for communication between the recessed matching cavity 101 and the airtight air chamber 0 are respectively provided in the inner wall of each recessed matching cavity 101 and at the bottom of the recessed matching cavity 101. The inner bottom of the chamber 1041 is provided with several inner convex parts 1042 corresponding to the recessed matching cavities 101 one by one, and the small communicating holes 102 can penetrate through the inner convex parts 1042. The wet blank transfer mold 10 also includes a closing mold plate 105 for closing the opening of the cavity 1041, and the airtight air chamber 0 is formed between the main mold plate 104 and the closing mold plate 105.

The inner convex part 1042 corresponds to the recessed matching cavity 101, so as to facilitate the development of the mold and reduce the manufacturing difficulty. The wet blank is not limited to the upper mold, and the product is not limited to the lower mold. That is to say, the wet blank can be transferred to the upper mold or the lower mold, and the corresponding product can be taken out from the lower mold or the upper mold. This objective can be achieved by the same device, which can be installed positively or reversely, or turned over by the end joint of the manipulator.

Wet blank transfer or product transfer can be performed through vacuum suction. There is an airtight air chamber in the wet blank mold, which is connected to the vacuum pipeline, and the vacuum cup is connected to the vacuum pipeline. For releasing the wet blank or product, vacuuming operation can be converted into blowing operation.

Figure 2:
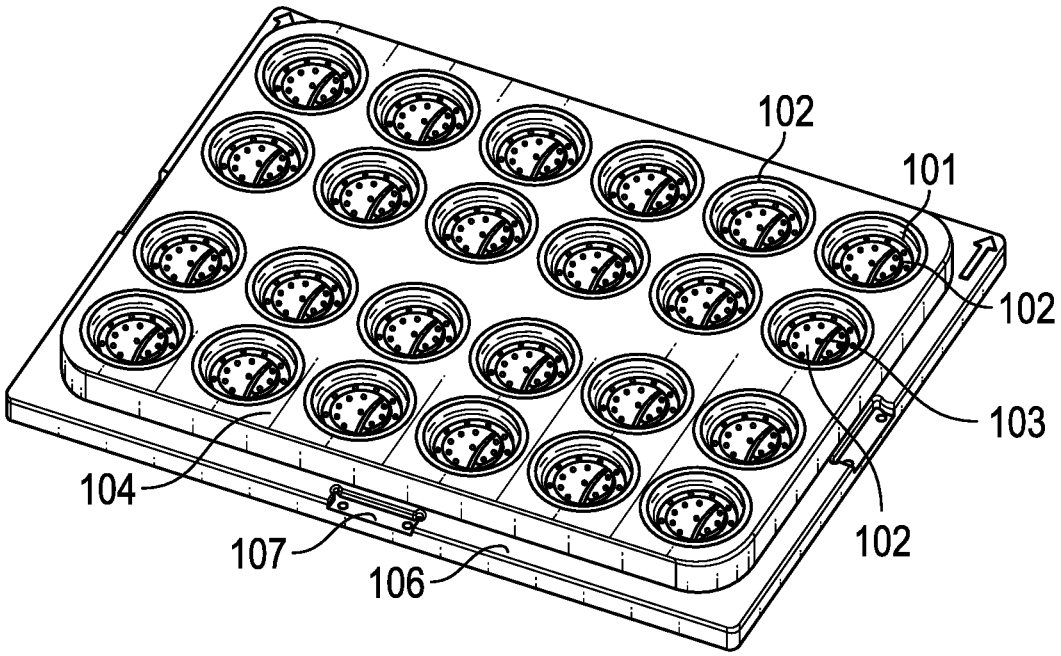
FIG. 2 is a schematic diagram of the front structure of the main mold plate of the transfer device of the present disclosure.
Figure 3:
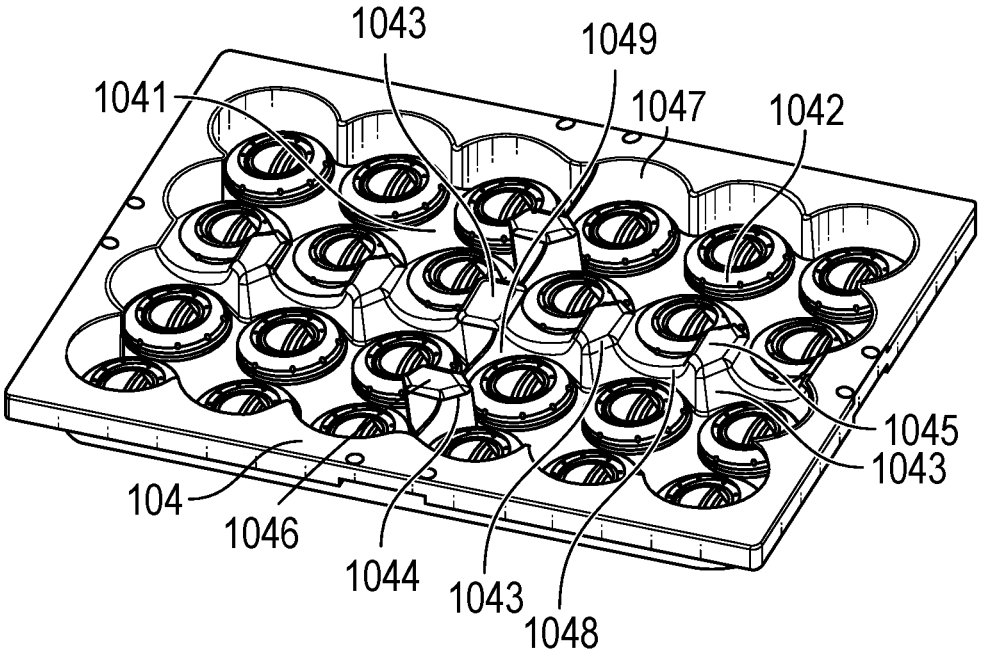
FIG. 3 is a schematic diagram of the back structure of the main mold plate of the transfer device of the present disclosure.
Figure 4:
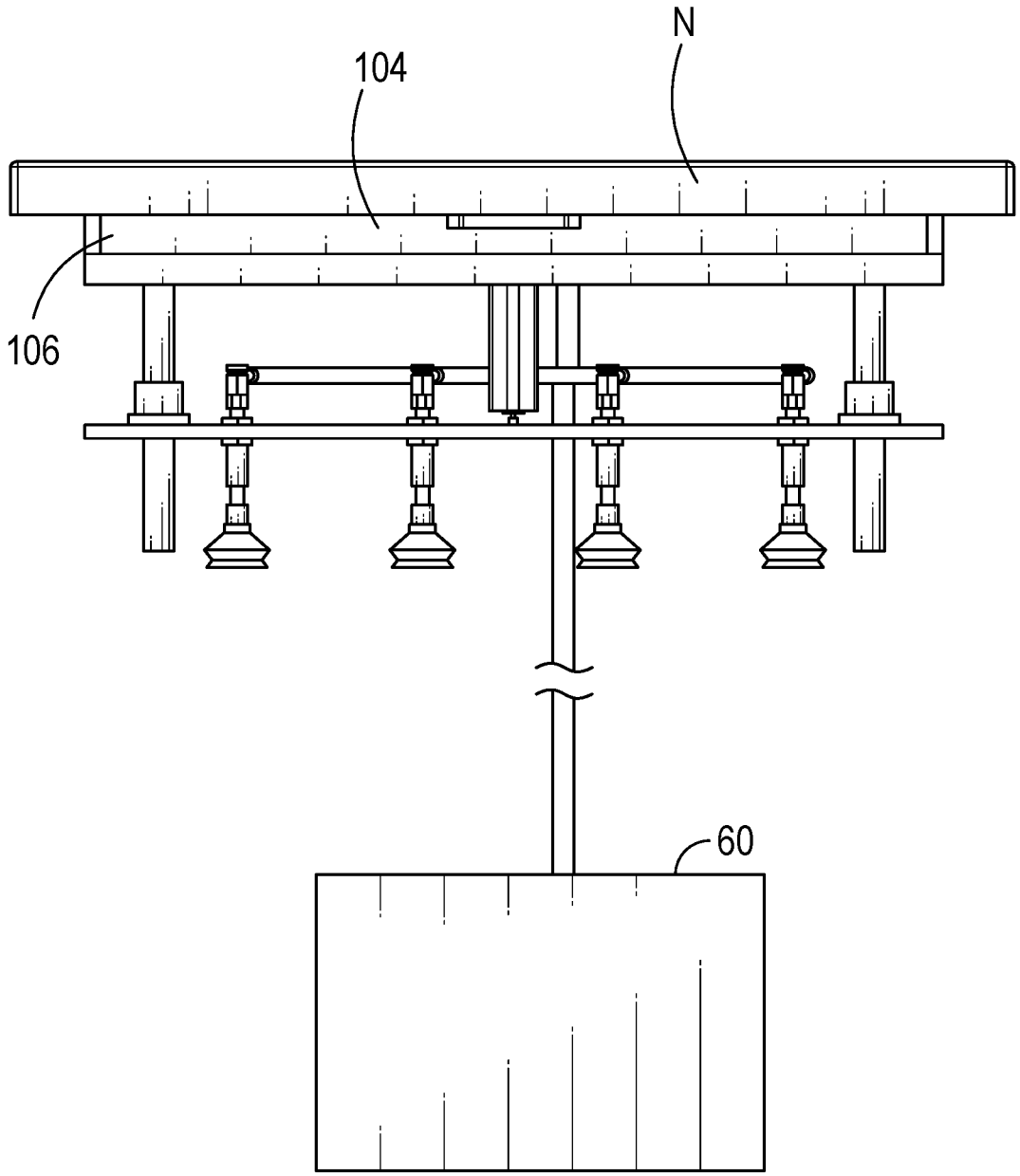
FIG. 4 is a schematic diagram of the connection structure between the transfer device and vacuum-pumping system of the present disclosure.
Figure 5:
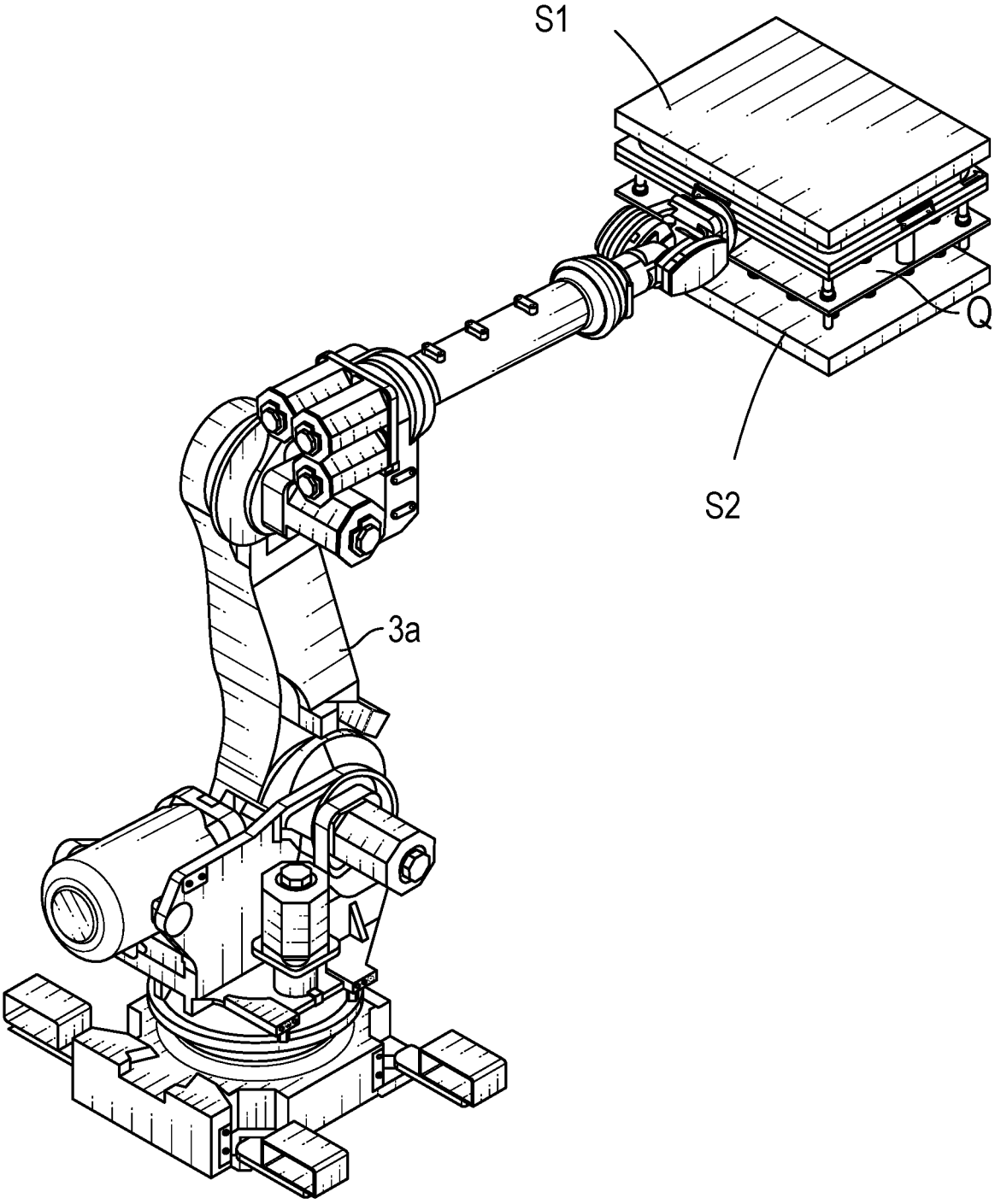
FIG. 5 is a structural diagram of the transfer device of the present disclosure after being installed on a manipulator.
Figure 6:
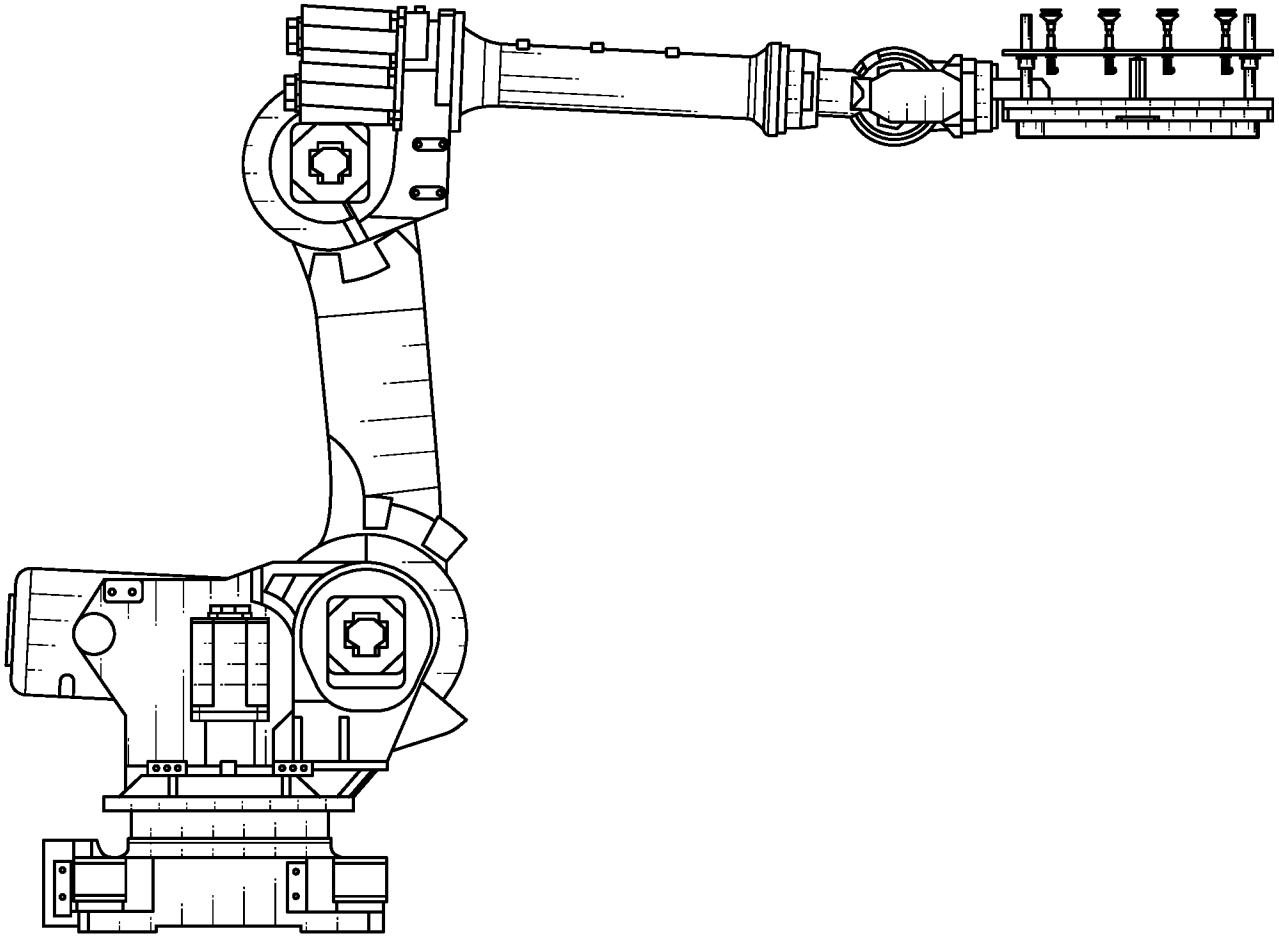
FIG. 6 is a structural schematic diagram of the transfer device in the first state of the present disclosure.
Figure 7:
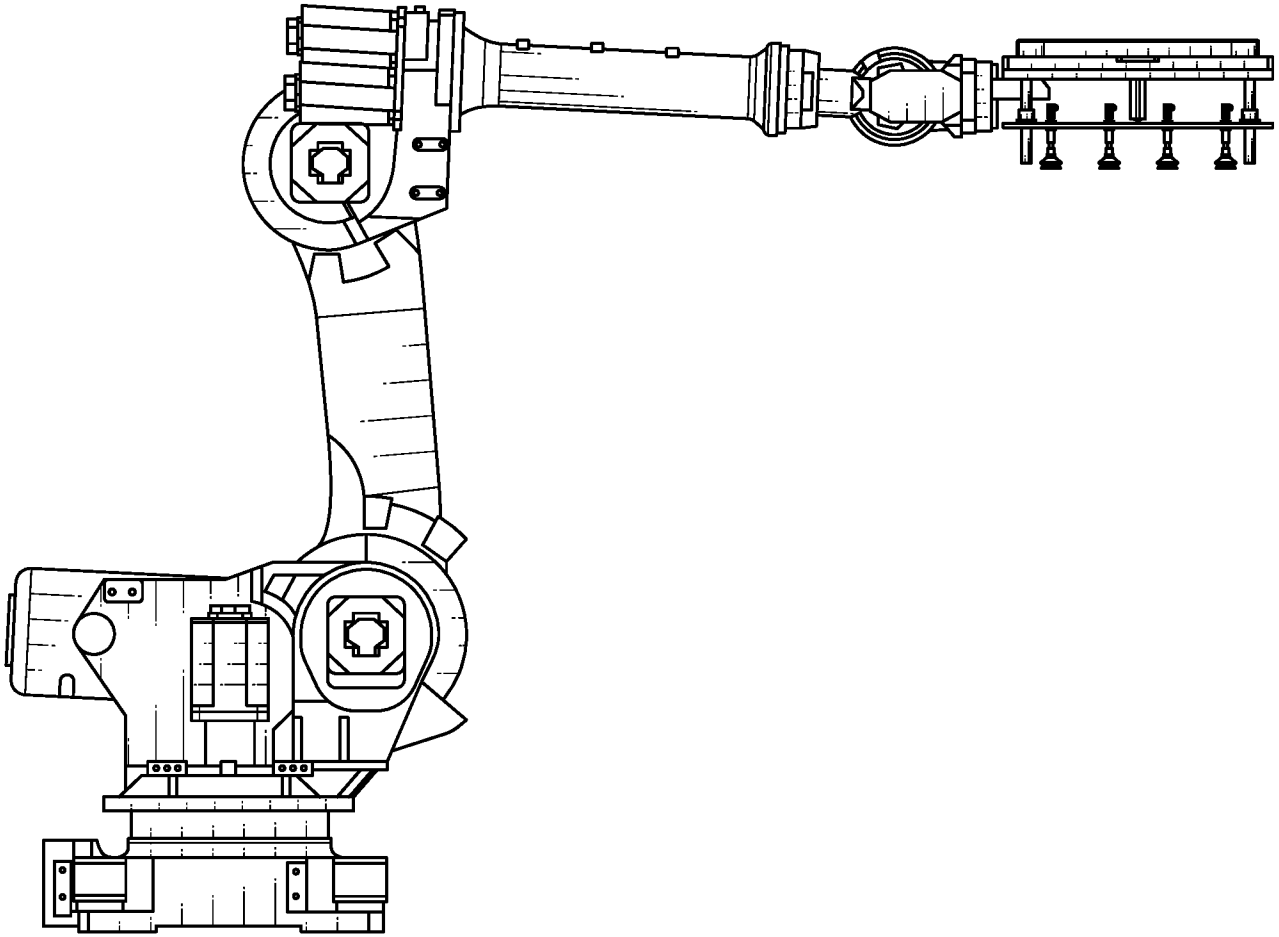
FIG. 7 is a structural schematic diagram of the transfer device in the second state of the present disclosure.

As shown in FIGS. 2-3, the bottom of the cavity 1041 is provided with a reinforcing supporting structure which is in contact with a surface of the closing mold plate 105 near the cavity 1041. Specifically, the reinforcing supporting structure of this embodiment includes several first reinforcing supporting bulges 1043 with uniform transverse spacing and several second reinforcing supporting bulges 1044 with uniform longitudinal spacing. The first reinforcing supporting bulges 1043 and the second reinforcing supporting bulges 1044 are located on the same line and at the lateral center of the chamber 1041, forming a cross shape. The end of the first reinforcing supporting bulge 1043 which is away from the bottom of the chamber 1041 abuts against a surface of the closing mold plate 105 near the chamber 1041, and the end of the second reinforcing supporting bulge 1044 which is away from the bottom of the chamber 1041 abuts against a surface of the closing mold plate 105 near the chamber 1041.

The first reinforcing supporting bulges 1043 and the second reinforcing supporting bulges 1044 can further improve the structural strength and prolong the service life of the closing mold plate 105.

A first supporting plane 1045 is provided at one end of each first reinforcing supporting bulge 1043 abutting against the closing mold plate 105, and a second supporting plane 1046 is provided at one end of each second reinforcing supporting bulge 1044 abutting against the closing mold plate 105, which are located in the same horizontal plane. The supporting plane can improve the stability and reliability of contact.

The inner wall of the chamber 1041 is provided with several arc-shaped concave surfaces 1047 connected in sequence, and the outermost inner convex part 1042 of the inner convex parts 1042 corresponds to the arc-shaped concave surfaces 1047 one by one.

In addition, six of recessed matching cavities 101 of this embodiment are taken as one area, and the front face of the wet blank transfer mold 10 is provided with four of such areas.

Secondly, two adjacent first reinforcing supporting bulges 1043 are connected by first arc-shaped connecting ribs 1048, two second reinforcing supporting bulges 1044 are located outside the middle-most first reinforcing supporting bulge 1043, and each second reinforcing supporting bulge 1044 is connected with the middle-most first reinforcing supporting bulge 1043 by second arc-shaped connecting rib 1049.

In addition, in order to facilitate disassembly and connection, the main mold plate 104 and the closing mold plate 105 in this embodiment are connected by a detachable connection structure. Specifically, the detachable connection structure includes an annular shoulder 106 provided in the circumferential direction of the main mold plate 104, the thickness of which is smaller than that of the main mold plate 104, and the back of the main mold plate 104 is flush with the back of the annular shoulder. Each side of the closing mold plate 105 is pierced with a locking bolt, which penetrates through the nail passing hole of the annular shoulder, and a locking nut is sheathed on the locking bolt, which is in contact with the front face of the annular shoulder.

The front face of the annular shoulder is provided with a yielding notch 107 communicating with the nail passing hole, and the locking nut is located in the yielding notch and contacts with the bottom surface of the yielding notch.

As shown in FIGS. 9-12, press 2*a* can include a lower base 2, four vertical guide posts 21 connected to the top of the lower base 2, an upper mold holder 3 connected to the upper ends of the four vertical guide posts 21, and a movable lower mold holder 4 positioned directly below the upper mold holder 3 and movably connected with the vertical guide posts 21. The movable lower mold holder 4 is connected with the press master cylinder 41, which drives the movable lower mold holder 4 to move up and down axially along the vertical guide posts 21. The press master cylinder 41 is fixed at the center of the lower base 2, and a telescopic rod of the press master cylinder 41 is connected facing upward with the center of the lower surface of the movable lower mold holder 4.

During production, the master cylinder 41 of the press drives the movable lower mold holder 4 to move up and down, which can improve the stability and reliability of lifting and lowering in cooperation with the vertical guide posts 21.

A transfer device Q is connected to a pulp molding manipulator 3*a*, and the transfer device Q is the above-mentioned "a transfer device applied to a pulp molding manipulator". The press 2*a* is provided with an auxiliary frame N located between the movable lower mold holder 4 and the upper mold holder 3, and the press is provided with a lifting drive mechanism 5 for driving the auxiliary frame to lift and lower in the vertical direction. The pulp molding manipulator forces the transfer device to extend into between the movable lower mold holder and the upper mold holder, and the lifting drive mechanism drives the auxiliary frame to contact with and forces the transfer device to move vertically upward or downward.

The auxiliary frame N includes a horizontally provided auxiliary push plate 1, which is made of metal material or non-metal material, and any material that can meet the strength requirements can be adopted in this embodiment.

The auxiliary push plate 1 is provided with a polygonal central through-hole 11. In an example, the polygonal central through-hole 11 in this embodiment is an octagonal through-hole, which can form the placement of the mold jig and contact with the mold jig, and force the mold jig to rise and fall under the action of the lifting drive mechanism.

Secondly, the periphery of the auxiliary push plate 1 is provided with outer sides corresponding to the hole walls of the octagonal through hole one by one, and the outer sides form an octagon.

Next, the upper and lower openings of the octagonal through-hole are respectively provided with first circular chamfers 111, and the two sides of each outer side are respectively provided with second circular chamfers 112.

Circular chamfering can avoid damaging mold jig or pulp products. Two cantilever bosses 12 are respectively provided at both ends of the auxiliary push plate 1, and each cantilever boss 12 is respectively provided with a vertically provided guide circular hole 121, and a reinforcing structure 13 is provided between the two cantilever bosses 12 provided at the same end.

Specifically, the reinforcing structure 13 includes transverse reinforcing ribs 131 connected between the two cantilever bosses 12 and connected with the outer wall of the auxiliary push plate 1, wherein longitudinal reinforcing ribs 132 are provided in the middle of the transverse reinforcing ribs 131 and the inner ends of the longitudinal reinforcing ribs 132 are connected with the outer wall of the auxiliary push plate 1.

The auxiliary push plate 1, cantilever bosses 12, transverse reinforcing ribs 131 and longitudinal reinforcing ribs 132 are integrally formed, which can improve the overall structural strength.

The lifting driving mechanism 5 drives the auxiliary push plate 1 to rise and fall between the movable lower mold holder 4 and the upper mold holder 3. At this time, under the action of the auxiliary push plate 1, the mold jig connected to the manipulator can be forced to rise or fall. That is, auxiliary push plate 1 is sheathed on a wet blank transfer mold 10 and connected to an annular 106 shoulder, so to enhance the stability of the pushing force, therefore the manipulator does not need to perform upward or downward thrust action, thereby ensuring the working reliability of the manipulator, and also prolonging the service life of the manipulator, so that the production can be carried out continuously and smoothly, which is more in line with the production requirements of enterprises.

The lifting drive mechanism 5 includes two fixed frames 51 respectively fixed on the top of the lower base 2, and the first cylinders 52 are respectively fixed in each fixed frame body 51, and the telescopic rods of the first cylinders 52 facing upwards and are connected to the middle of the lower surface of the transverse reinforcing ribs 131 one by one.

The fixed frame body 51 is a rectangular frame and is vertically fixed. The upper central area of the fixed frame body 51 is provided with a first elongated hole 511, and the lower central area of the fixed frame body 51 is provided with a second elongated hole 512. The telescopic rod of the first cylinder 52 penetrates through the first elongated hole 511 and a fixing plate 513 is sheathed on the upper end of the cylinder body of the first cylinder 52. The fixing plate 513 is located on the upper surface of the opening of the first elongated hole 511, and several bolts 514 penetrate through the fixing plate 513. The bolts 514 are in a threaded connection with a threaded hole at the top of the fixing frame body 51, and the lower end of the first cylinder 52 extends through the second elongated hole 512.

The design of elongated holes is to facilitate position movement and adjustment. When the press is in operation, the movable lower mold holder 4 moves upward under the driving of the press master cylinder 41, and then the lower pulp product mold on the movable lower mold holder 4 and the upper pulp product mold on the upper mold holder 3 cooperate with each other to process pulp products. After the processing is finished, the manipulator at this time needs to obtain pulp products. The pulp products are obtained and released to the next station by installing a mold jig on the manipulator. In the process of obtaining or releasing, the auxiliary push plate 1 is forced to rise or fall in the vertical direction by the lifting drive mechanism 5, and the auxiliary push plate 1 is sheathed on the mold jig, which can assist the rising or falling of the mold jig, thereby eliminating the alarm caused by the upward or downward movement of the mold jig by using the manipulator.

The working principle of this embodiment is as follows:

The forming machine S transfers the pulp to the press through the transfer device on the manipulator after forming and extruding, that is, the wet blank transfer mold acquires the pulp wet blank products formed by the forming machine S, and at the same time, after the transfer device of the manipulator enters the press and stops at the set position (i.e., between the upper mold and the lower mold), there are two schemes:

In the first scheme, the wet pulp product is located at one side of the upper mold, and the upper mold obtains the wet pulp product by suction, and at the same time, the vacuum cup goes down to obtain the molded pulp product on the lower mold and transfers it;

In the second scheme, the wet pulp product is located at one side of the lower mold, and at this time, the lower mold obtains the wet pulp product by suction, and at the same time, the vacuum cup goes up to obtain the molded pulp products on the upper mold and transfers it.

The processing method of the pulp molded product comprises the following steps:

S1. Molding, wherein the paper pulp is molded by a molding machine S to obtain a wet paper pulp product; the wet pulp products include pulp container, pulp cup cover and so on S2. Transferring, wherein a wet blank transfer mold Q is installed on the pulp molding manipulator 3*a*, the transfer device includes a wet blank transfer mold that is internally provided with an airtight air chamber inside, a front face of the wet blank transfer mold is provided with at least one recessed matching cavity which can be sheathed on the outside of a pulp wet blank container and is recessed towards the airtight air chamber, and the recessed matching cavity matches the pulp wet blank container; several small communicating holes for communication between the recessed matching cavity and the airtight air chamber are respectively provided in an inner wall of each recessed matching cavity and at the bottom of the recessed matching cavity, the small communicating holes provided in the inner wall of the recessed matching cavity are circumferentially uniformly distributed to form at least one circle in an encircling manner, and the small communicating holes provided at the bottom of the recessed matching cavity are circumferentially uniformly distributed to form at least one circle in an encircling manner; a moving frame parallel to the wet blank transfer mold is connected to a back face of the wet blank transfer mold via a guiding mechanism; a driver is connected between the back face of the wet blank transfer mold and the moving frame and drives the moving frame to move relative to the wet blank transfer mold; several evenly spaced vacuum cups are provided on the moving frame, and the vacuum cups and the airtight air chamber are respectively connected to a vacuum-pumping system.

The pulp molding manipulator drives the wet blank transfer mold to approach the pulp wet blank product, and the pulp wet blank product is vacuum sucked by the wet blank transfer mold, forcing the pulp wet blank product to leave the forming machine;

S3. Pressing, wherein a lower mold S2 and an upper mold S1 are installed in the press 2*a*, and the lower mold is positioned below the upper mold; the auxiliary frame N on the press is driven by the lifting driving mechanism 5 to sleeve on the wet blank transfer mold of the transfer device and force the pulp wet blank product vacuum sucked by the wet blank transfer mold to be transferred to the lower mold, that is, the auxiliary push plate is sleeved around the main template 104 of the wet blank transfer mold and contacts with the annular shoulder 106; then, the lifting drive mechanism drives the auxiliary push plate to lift or fall in the vertical direction; the lower mold moves upwards to approach the upper mold or the upper mold moves downwards to approach the lower mold to close the mold, so as to press the wet pulp product to obtain the pulp product; the lower mold and the upper mold withdraw to cancel the mold closing and the pulp product is vacuum sucked by the upper mold; before the lower mold rises to approach the upper mold or the upper mold declines or lowers to approach the lower mold to realize the mold closing, the driver drives the moving frame to move vertically upwards relative to the wet blank transfer mold and force the vacuum cups to suck the pulp product, finally making the pulp product leave the press.

Another example of working can be as follows: the processing method of the pulp molded product includes the following steps:

S1. Molding operation, wherein the paper pulp is molded by a molding machine S to obtain a wet paper molded product.

S2. Transferring operation, wherein a wet blank transfer mold Q is installed on the pulp molding manipulator 3*a*, the transfer device includes a wet blank transfer mold that is internally provided with an airtight air chamber inside. A front face of the wet blank transfer mold is provided with at least one recessed matching cavity which can be sheathed on the outside of a pulp wet blank container and is recessed towards the airtight air chamber, and the recessed matching cavity matches the pulp wet blank container. Several small communicating holes for communication between the recessed matching cavity and the airtight air chamber are respectively provided in an inner wall of each recessed matching cavity and at the bottom of the recessed matching cavity. The small communicating holes provided in the inner wall of the recessed matching cavity are circumferentially uniformly distributed to form at least one circle in an encircling manner, and the small communicating holes provided at the bottom of the recessed matching cavity are circumferentially uniformly distributed to form at least one circle in an encircling manner. A moving frame parallel to the wet blank transfer mold is connected to a back face of the wet blank transfer mold via a guiding mechanism; a driver is connected between the back face of the wet blank transfer mold and the moving frame and drives the moving frame to move relative to the wet blank transfer mold; several evenly spaced vacuum cups are provided on the moving frame, and the vacuum cups and the airtight air chamber are respectively connected to a vacuum-pumping system.

The pulp molding manipulator can drive the wet blank transfer mold to approach the pulp wet blank product, and the pulp wet blank product is vacuum sucked by the wet blank transfer mold, forcing the pulp wet blank product to leave the forming machine;

S3. Pressing operation, wherein a lower mold and an upper mold are installed in the press 2*a*, and the lower mold can be positioned below the upper mold. The auxiliary frame N on the press can be driven by the lifting driving mechanism 5 to sleeve on the wet blank transfer mold of the transfer device and force the pulp wet blank product vacuum sucked by the wet blank transfer mold to be transferred to under the lower mold, that is, the auxiliary push plate is sleeved around the main template 104 of the wet blank transfer mold and contacts with the annular shoulder 106; then, the lifting drive mechanism 5 can drive the auxiliary push plate to lift or fall in the vertical direction. The upper mold can suck the pulp blank product by vacuum, the lower mold moves upwards to approach the upper mold or the upper mold can move downwards to approach the lower mold to close the mold, so as to press the wet pulp product to obtain the pulp product. The lower mold and the upper mold can withdraw to cancel the mold closing and the pulp product can be put on the lower mold. Before the lower mold rises to approach the upper mold or the upper mold declines or lowers to approach the lower mold to realize the mold closing, the driver can drive the moving frame to move vertically downward relative to the wet blank transfer mold and forces the vacuum cups to suck the pulp product, finally forcing the pulp product to leave the press.

What is claimed is:

1. A pulp molding production line, comprising:

a molding machine configured to mold paper pulp into a semi-finished pulp wet blank product;

a pulp molding manipulator disposed operatively downstream of said molding machine;

a press disposed operatively downstream of said pulp molding manipulator and configured to press mold the pulp wet blank product from said at least one molding machine into a finished pulp product; and a transfer device coupled to said pulp molding manipulator and configured to be moved by said pulp molding manipulator between said molding machine upstream and said press downstream, remove the pulp wet blank product from said molding machine, transfer the pulp wet blank product to said press to be press molded into a finished pulp product, and remove the finished pulp product from said press, said transfer device comprising:

a wet blank transfer mold having, an airtight air chamber defined therein, a front face defining at least one recessed matching cavity that is recessed toward said airtight chamber, has a cavity shape that is complementary to the shape of an outer surface of the pulp wet blank product, and is configured to sheath the outer surface of the pulp wet blank product, a plurality of communicating holes defined in each of an inner wall and a bottom wall of the recessed matching cavity that are uniformly distributed to form separate circular patterns in each of the respective walls;

a guiding mechanism coupled to a back face of said wet blank transfer mold;

a moving frame disposed parallel to said wet blank transfer mold and coupled to said guiding mechanism, said guiding mechanism configured to permit said moving frame to be moved towards or away from said back face of said wet blank transfer mold;

a driver operatively coupled to each of said back face of said wet blank transfer mold and said moving frame, and configured to drive said moving frame towards or away from said wet blank transfer mold; and a plurality of vacuum cups disposed on said moving frame, said vacuum cups and said airtight air chamber being in operative communication with a vacuum-pumping system configured to draw a vacuum in said airtight chamber and each of said vacuum cups.

2. The pulp molding production line of claim 1, wherein said wet blank transfer mold further comprises:

a main mold plate having a first cavity defined in a back face thereof, a bottom portion of said first cavity having a plurality of inner convex parts disposed therein, wherein said front face of said wet blank transfer mold is a front face of said main mold plate, wherein said at least one recessed matching cavity in said front face of said wet blank transfer mold is a plurality of recessed matching cavities arranged in an array in said front face of said main mold plate, wherein each of said inner convex parts in said first cavity corresponds to a different of each of said recessed matching cavities in said front face of said main mold plate, and wherein said plurality of communicating holes are defined in each of said recessed matching cavities, and define a plurality of air communication paths between each of the recessed matching cavities, through said inner convex parts, and to said airtight chamber; and a closing mold plate having a front face sealed against said back face of said main mold plate so as to close said first cavity opening and form said airtight chamber therebetween.

3. The pulp molding production line of claim 2, wherein said bottom portion of said first cavity includes a reinforcing supporting structure in contact with a front surface of said closing mold plate near said airtight chamber.

4. The pulp molding production line of claim 3, wherein said reinforcing supporting structure comprises:

a plurality of first reinforcing supporting bulges, extending from said bottom portion of said first cavity, having uniform transverse spacing and arranged in a straight line through a transverse center of said airtight chamber; and a plurality of second reinforcing supporting bulges, extending from said bottom portion of said first cavity, having uniform longitudinal spacing and arranged in a straight line through a longitudinal center of said airtight chamber, so as to form a cross shape with said plurality of first reinforcing supporting bulges within said airtight chamber, wherein a distal end of each of said plurality of first and second reinforcing supporting bulges that is distal to said bottom portion of said first cavity abuts against said front surface of said closing mold plate near to said airtight chamber.

5. The pulp molding production line of claim 4, wherein a first supporting plane is defined at said distal end of each first reinforcing supporting bulge, and a second supporting plane is defined at said distal end of each second reinforcing supporting bulge, wherein the first supporting plane and the second supporting plane are located in the same horizontal plane parallel to said front face of said closing mold plate.

6. The pulp molding production line according to of claim 4, wherein said plurality of inner convex parts disposed in said cavity of said back face of said main mold plate are arranged in an array that is complementary to said array of recessed matching cavities in said front face of said main mold plate, wherein an inner side wall of said airtight chamber defines a plurality of arc-shaped concave surfaces connected in sequence, and wherein said inner convex parts that are arranged at an outermost periphery of said array of inner convex parts each correspond to separate ones of said arc-shaped concave surfaces.

7. The pulp molding production line of claim 1, wherein said guiding mechanism comprises:

a plurality of guide posts, each affixed at a first end thereof to a back face of said wet blank transfer mold and extending parallel to each other and away from said back face of said wet blank transfer mold; and a plurality of guide sleeves coupled to said moving frame about a plurality of guide sleeve fixing holes defined in said moving frame, each of said guide sleeves being disposed on a separate one of said plurality of guide posts by insertion of said guide posts through said guide sleeves, so as to permit said guide sleeves to slide along a length of said guide posts.

8. The pulp molding production line of claim 1, wherein said plurality of communicating holes defined in said bottom wall of said recessed matching cavity are circumferentially uniformly distributed to form two separate circular patterns in said bottom wall of said recessed matching cavity.

9. The pulp molding production line of claim 1, wherein said press comprises:

a lower base;

a plurality of vertical guide posts connected to a top of the lower base;

an upper mold holder connected to upper ends of said vertical guide posts;

a movable lower mold holder movably connected to said vertical guide posts;

a master cylinder connected to said lower mold holder and configured to vertically drive said lower mold holder along said vertical guide posts;

an auxiliary frame disposed between said movable lower mold holder and said upper mold holder; and a lifting drive mechanism coupled to said auxiliary frame that is configured to vertically drive said auxiliary frame along said vertical guide posts.

10. The pulp molding production line of claim 9, wherein said auxiliary frame comprises:

an auxiliary push plate arranged horizontally with respect to said press and having a polygonal central through hole defined therein;

a pair of cantilever bosses respectively disposed at each of two opposing ends of said auxiliary push plate, wherein each cantilever boss respectively includes a vertical guide hole defined therein;

a reinforcing structure disposed between said cantilever bosses in each pair of cantilever bosses located that are arranged at the same end of said auxiliary push plate, said reinforcing structure comprising:

a transverse reinforcing rib disposed between each of said cantilever bosses in said pair of cantilever bosses, and connected with an outer wall of said auxiliary push plate; and a longitudinal reinforcing rib disposed in a middle of said transverse reinforcing rib, and having an inner end connected with the outer wall of the auxiliary push plate.

11. The pulp molding production line of claim 10, wherein said lifting driving mechanism comprises:

a fixed frame body affixed to a top portion of said lower base;

a first cylinder disposed in said fixed frame body; and a telescopic rod disposed in said first cylinder and configured to be vertically driven thereby, said telescopic rod coupled to a middle part of a lower surface of one of said transverse reinforcing ribs.

12. The pulp molding production line of claim 11, wherein said fixed frame body is rectangular and vertically fixed and defines each of a first elongated hole in an upper central area thereof and a second elongated hole in a lower central area thereof, wherein said telescopic rod through said first elongated hole, wherein a lower end of said first cylinder extends through said second elongated hole, and wherein said fixed frame body further comprises a fixing plate coupled to an upper end of said first cylinder at said first elongated hole.

13. A pulp molding processing method in a pulp molding production line, comprising performing the following steps:

molding paper pulp by a pulp molding machine S, to obtain a pulp wet blank molded product;

transferring by a pulp molding manipulator 3*a*, the pulp wet blank molded product, from the molding machine to a press, wherein the pulp molding manipulator 3*a* having a wet blank transfer mold installed thereon which the wet blank transfer mold being a part of a transfer device Q, wherein inside the wet blank transfer mold having an internal airtight air chamber, wherein a front face of the wet blank transfer mold having at least one recessed matching cavity that is configured to be sheathed on an outside of a pulp wet blank container and the at least one recessed matching cavity matches the pulp wet blank container, is recessed towards the airtight air chamber;

a plurality of small communicating holes are disposed in an inner wall of each recessed matching cavity and at a bottom of the recessed matching cavity for communication between the recessed matching cavity and the airtight air chamber, wherein the plurality of small communicating holes provided in the inner wall of the recessed matching cavity and the small communicating holes provided at the bottom of the recessed matching cavity are circumferentially and uniformly distributed, respectively forming at least one circle in an encircling manner;

a moving frame parallel to the wet blank transfer mold is connected to a back face of the wet blank transfer mold via a guiding mechanism;

a driver connected between the back face of the wet blank transfer mold and the moving frame drives the moving frame to move relative to the wet blank transfer mold, and several evenly spaced vacuum cups are provided on the moving frame, wherein the vacuum cups and the airtight air chamber are respectively connected to a vacuum-pumping system;

wherein the pulp molding manipulator 3*a* is configured to drive the wet blank transfer mold to approach the pulp wet blank molded product that is held by vacuum suction of the wet blank transfer mold, and to remove the pulp wet blank molded product away from the pulp molding machine S;

pressing the pulp wet blank paper molded product by a press 2*a* to obtain a pulp paper product, wherein the press 2*a* having installed:

a lower mold and an upper mold which the lower mold is positioned below the upper mold;

an auxiliary frame N on the press 2*a* which is driven by a lifting driving mechanism to sleeve on the wet blank transfer mold of the transfer device Q, and force the pulp wet blank molded product which is held by vacuum suction of the wet blank transfer mold for transfer to the lower mold, wherein an auxiliary push plate is sleeved around a main template of the wet blank transfer mold that makes contacts with an annular shoulder;

wherein a lifting drive mechanism in the press 2*a* drives the auxiliary push plate to lift or fall in the vertical direction, such that the lower mold moves upwards to approach the upper mold, or the upper mold moves downwards to approach the lower mold to close the mold, so as to press the pulp wet blank molded product to obtain the pulp product, wherein the lower mold and the upper mold withdraw to cancel the mold closing, and the pulp product is configured to be vacuum sucked by the upper mold;

wherein before the lower mold rises to approach the upper mold, or when the upper mold declines or lowers to approach the lower mold to realize the mold closing, the driver drives the moving frame to move vertically upwards relative to the wet blank transfer mold to force the vacuum cups to suck the pulp product that causes the pulp product to leave the press 2*a*.

* * * * *